US005599007A

United States Patent [19]

Oliveira

[11] Patent Number: 5,599,007

[45] Date of Patent: Feb. 4, 1997

[54] CLAMP

[76] Inventor: Paul L. Oliveira, 517 Anuhea Pl., Volcano, Hi. 96785

[21] Appl. No.: 493,591

[22] Filed: Jun. 22, 1995

[51] Int. Cl.[6] ..... B25B 1/24

[52] U.S. Cl. ..... 269/271; 269/902

[58] Field of Search ..... 269/902, 271, 269/277, 283, 287, 246

[56] References Cited

U.S. PATENT DOCUMENTS

| | | | |
|---|---|---|---|
| 1,071,289 | 8/1913 | Bader | 269/902 |
| 1,964,194 | 6/1934 | Coe | 269/271 |
| 2,371,831 | 3/1945 | Leming | 269/902 |
| 4,070,012 | 1/1978 | La Rocco | 269/902 |
| 4,139,189 | 2/1979 | Wietrzyk | 269/902 |
| 5,005,813 | 4/1991 | Lawrence | 269/902 |
| 5,149,071 | 9/1992 | Oliveira | 269/902 |

*Primary Examiner*—Robert C. Watson
*Attorney, Agent, or Firm*—Joseph H. McGlynn

[57] ABSTRACT

A clamp which can be held in a vise, and the clamp has a plurality of clamping portions which will allow it to be held in the vise in a plurality of positions.

3 Claims, 2 Drawing Sheets

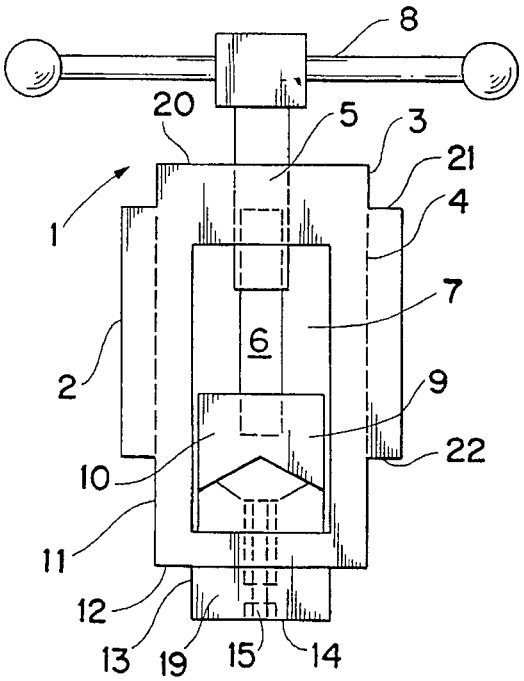
FIG. 1
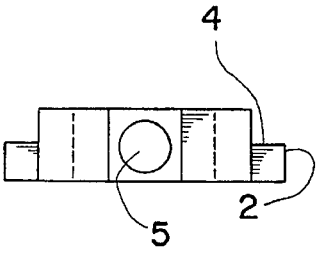
FIG. 2
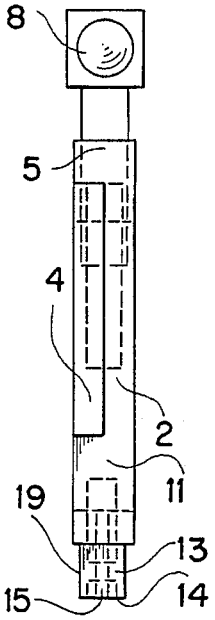
FIG. 3
FIG. 4
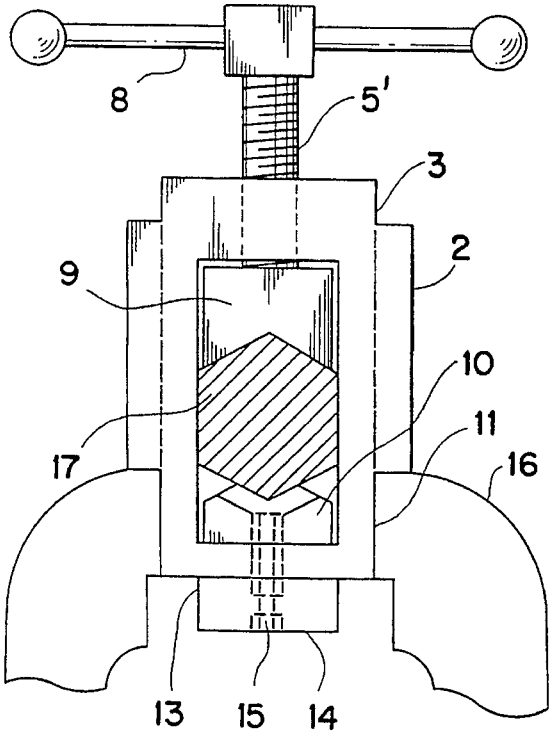
FIG. 5
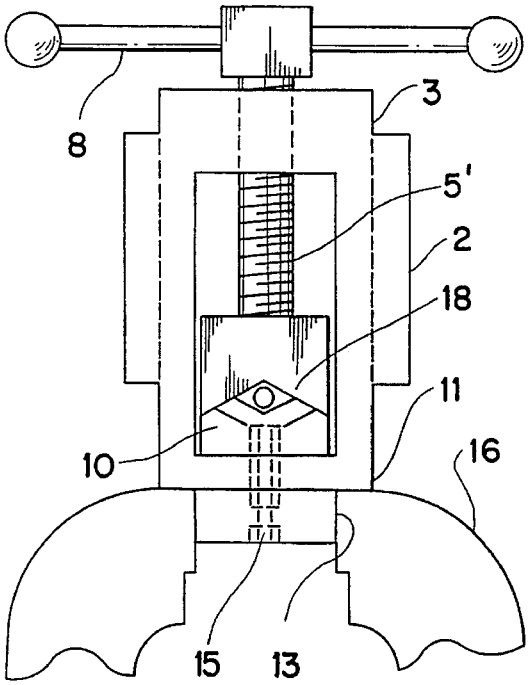

CLAMP

BACKGROUND OF THE INVENTION

This invention relates in general to a clamp and in particular to a clamp which can be held in a variety of positions in a vise for holding a variety of elements.

DESCRIPTION OF THE PRIOR ART

In the prior art various clamps have been known which can be placed in a vise for holding work pieces. However, these prior art clamps have been limited in the position they must be placed in the vise and, therefore the position of the elements they hold will also be limited. This will present problems when a person is trying to perform an operation such as drilling or filing the element being held.

SUMMARY OF THE INVENTION

This invention is directed to a clamp which can be held in a vise attached to a work bench or other surface, and will hold a variety of elements such as bolts, boltheads, screws, screw heads, hose end fittings, spark plugs, tubing of any shape and a variety of other mechanical parts, tools, and accessories.

Conventional vises provide a pair of clamping jaw faces for holding work pieces. Therefore, the position of the element being clamped is limited. Accessories that can be inserted in a vise provide a little more flexibility, but are still limited in their flexibility. The present invention overcomes these disadvantages and provides a clamp that can be placed in a vise to hold a work piece in a variety of positions so the operator can perform various operations in a position that is convenient and safe.

It is an object of the present invention to provide a clamp that can be placed in a vise in a variety of positions.

It is an object of the present invention to provide a clamp that will increase the stability and retention of the work piece being held.

It is an object of the present invention to provide a clamp that can be used by itself or can be held in a conventional vise.

These and other objects and advantages of the present invention will be fully apparent from the following description, when taken in connection with the annexed drawings.

BRIEF DESCRIPTION OF THE DRAWINGS

FIG. 1 is a front view of the clamp of the present invention.

FIG. 2 is an end view of the clamp of the present invention with the horizontal portion of the handle removed for clarity.

FIG. 3 is a side view of the clamp of the present invention.

FIG. 4 is a view of the clamp of the present invention being held in a vise in one of the many positions available.

FIG. 5 is a view of the clamp of the present invention being held in a vise in another of the many positions available.

DESCRIPTION OF THE PREFERRED EMBODIMENT

Figure 6:
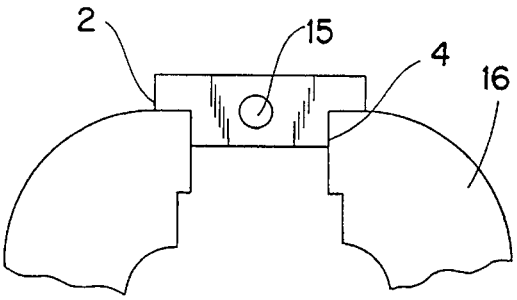
FIGS. 6–9 are views of the clamp of the present invention being held in a vise in several of the many positions available.

Referring to FIG. 1, the clamp 1 of the present invention is shown, having sides 2, top 20, and a bottom 14. A rotatable handle 8 is attached to the top of the clamp 20 by means of an externally threaded shaft 5 which cooperates with an internally threaded aperture in the clamp. A movable upper jaw section 9 is attached to shaft 5 by an externally threaded stud 6 which is connected to an internally threaded aperture in the bottom of shaft 5. Other methods of connecting the upper jaw section 9 and handle 8 may be used without departing from the scope of the present invention. For example, as shown in FIG. 4, a externally threaded shaft 5' can be fixedly attached to handle 8 and the lower end of threaded shaft 5' can be rotatably attached to movable upper jaw section 9.

The clamp body has a rectangular opening 7 in which movable upper jaw section 9 can move up and down. At the lower portion of opening 7 is a fixed lower jaw 10. It should be noted that the upper and lower jaws are shown as having concave faces, however they could be formed with any shaped face, or even have different shaped face inserts that could be inserted to hold different shaped elements.

The top 20 is joined to the side 2 by a stepped portion or partial channel consisting of a vertical section 3 and a horizontal section 21. As shown in FIGS. 2 and 3 the side of the clamp has an stepped portion or partial channel which forms a first vise clamping portion. FIG. 6 shows the surface 4 held in a vise 16. Toward the bottom 14 of the clamp is a second vise clamping portion 11, which is joined to side 2 by a horizontal section 22. Portions 11 and 22 form another stepped portion or partially channel. Below this clamping portion is a third vise clamping portion 13, which is joined to surface 11 by a horizontal surface 12. Portions 12 and 13 form another stepped portion or partially channel. At the bottom of the clamp is an aperture 15 which communicates with the face of the fixed lower jaw 10. This aperture allows a drill bit to be inserted through the bottom of the clamp to drill a hole in an object held in the clamp.

In FIGS. 4–9, the clamp of the present invention is shown held in a vise 16 in a variety of positions. In FIG. 4, the second vise clamping portion 11 is held in the vise 16 and a relatively large object such as a hexagonal bolt 17 is held in between the upper and lower jaws 9 and 10, respectively.

In FIG. 5, the third vise clamping portion 13 is held in the vise 16 and a relatively small object such as a nail 18 is held in between the upper and lower jaws 9 and 10, respectively. In FIG. 6, the first vise clamping portion 4 is held in the vise 16.

Figure 7:
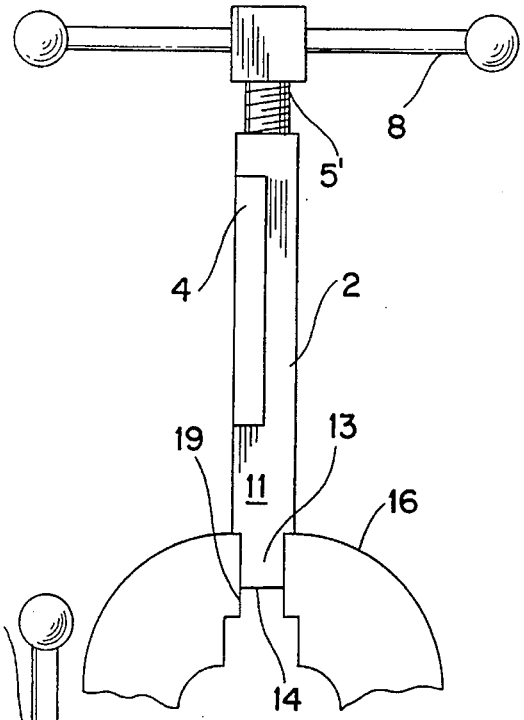

In FIG. 7, the fourth vise clamping portion 19 is shown being held in the vise 16.

Figure 8:
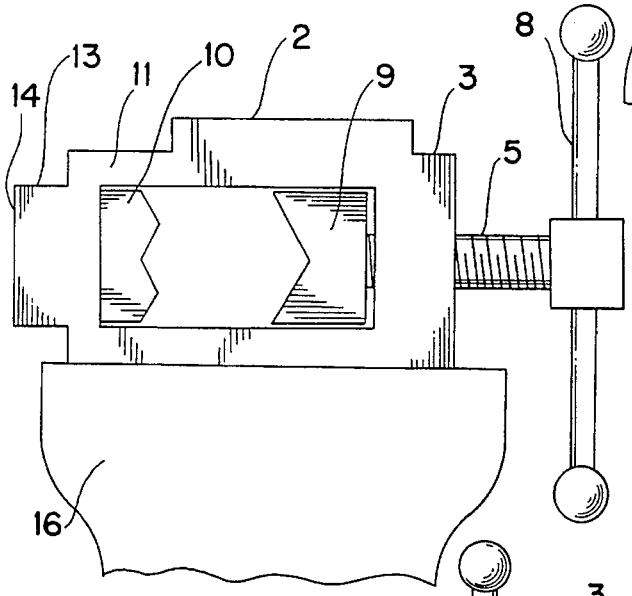

In FIG. 8, the fifth vise clamping portion 2 is shown being held in the vise 16.

Figure 9:
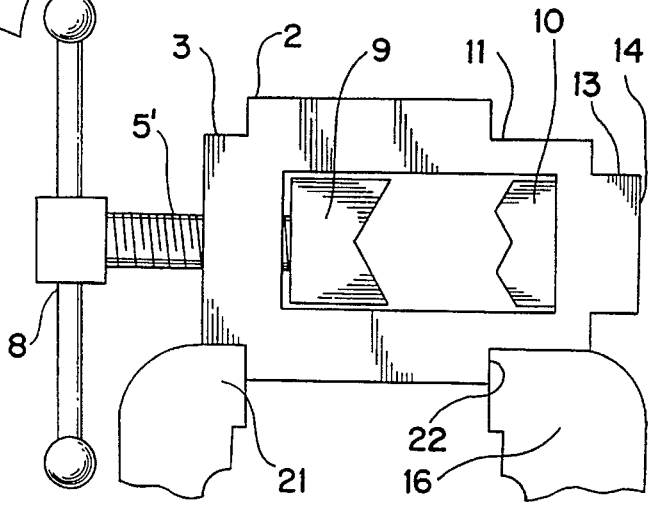

In FIG. 9, the sixth vise clamping portions 21 and 22 are shown being held in the vise 16.

As can be seen the clamp 1 with the various clamping portions, that are formed as stepped portions or partially channels, that allows a person to position the clamp within a vise in a variety of positions. This allows the person to select the position that is best suited for the type of operation he wants to perform. This provides a firm, stable grip on the work piece, and allows the operator to position the work piece so he can most easily perform various operations, such as drilling, filing sanding, etc.

Although the clamp and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A clamp comprising:

a main body portion having a top and a bottom, and a handle operator attached to said top of said main body portion, a rectangular opening in said main body portion, a movable jaw attached to said handle operator, and a fixed jaw attached to said main body portion, said movable and said fixed jaws being at least partially positioned within said rectangular opening, said main body portion having a plurality of clamping surface means for attaching said clamp to a vise in a plurality of positions, said plurality of clamping surface means consist of partial channels, one of said partial channels is positioned on said main body portion approximately midway between said top and said bottom of said main body portion, whereby said clamp can be positioned in said vise in an optimum position for performing work on a work piece.

2. A clamp comprising:

a main body portion having a top and a bottom, and a handle operator attached to said top of said main body portion, a rectangular opening in said main body portion, a movable jaw attached to said handle operator, and a fixed jaw attached to said main body portion, said movable and said fixed jaws being at least partially positioned within said rectangular opening, said main body portion having a plurality of clamping surface means for attaching said clamp to a vise in a plurality of positions, said plurality of clamping surface means consist of a series of stepped portions on said main body portion, a first stepped portion extending parallel to at least one side of said main body portion, a second stepped portion below said first stepped portion also extending parallel to said at least one side of said main body portion, and a third stepped portion below said second stepped portion and also extending parallel to said at least one side of said main body portion.

3. A clamp comprising:

a main body portion having a top and a bottom, and a handle operator attached to said top of said main body portion, a rectangular opening in said main body portion, a movable jaw attached to said handle operator, and a fixed jaw attached to said main body portion, said movable and said fixed jaws being at least partially positioned within said rectangular opening, said main body portion having a plurality of clamping surface means for attaching said clamp to a vise in a plurality of positions, said plurality of clamping surface means consist of a series of stepped portions on said main body portion, a first pair of stepped portions extending parallel to a longitudinal axis of said main body portion and positioned on opposite sides of said main body portion, a second pair of stepped portions below said first pair of stepped portions and, also, extending parallel to said longitudinal axis of said main body portion, and a third pair of stepped portions below said second pair of stepped portions and, also, extending parallel to said longitudinal axis of said main body portion.

* * * * *